US012408700B2

(12) United States Patent
Lord

(10) Patent No.: US 12,408,700 B2
(45) Date of Patent: Sep. 9, 2025

(54) ELECTRONIC VAPOR PROVISION DEVICE

(71) Applicant: NICOVENTURES TRADING LIMITED, London (GB)

(72) Inventor: Christopher Lord, London (GB)

(73) Assignee: NICOVENTURES TRADING LIMITED, London (GB)

( * ) Notice: Subject to any disclaimer, the term of this patent is extended or adjusted under 35 U.S.C. 154(b) by 116 days.

(21) Appl. No.: 17/736,909

(22) Filed: May 4, 2022

(65) Prior Publication Data

US 2022/0256920 A1 Aug. 18, 2022

Related U.S. Application Data

(60) Continuation of application No. 16/750,077, filed on Jan. 23, 2020, now Pat. No. 11,350,666, which is a continuation of application No. 15/959,687, filed on Apr. 23, 2018, now Pat. No. 10,582,729, which is a division of application No. 14/415,540, filed as application No. PCT/EP2013/064950 on Jul. 15, 2013, now Pat. No. 9,974,335.

(30) Foreign Application Priority Data

Jul. 16, 2012 (GB) ..... 1212603

(51) Int. Cl.

| | |
|---|---|
| ***A24F 40/40*** | (2020.01) |
| ***A24F 40/44*** | (2020.01) |
| ***A24F 40/46*** | (2020.01) |
| *A24F 40/10* | (2020.01) |

(52) U.S. Cl.

CPC ..... *A24F 40/44* (2020.01); *A24F 40/40* (2020.01); *A24F 40/46* (2020.01); *A24F 40/10* (2020.01)

(58) Field of Classification Search

CPC ..... A24F 40/10; A24F 40/40; A24F 40/42; A24F 40/44; A24F 40/46

See application file for complete search history.

(56) References Cited

U.S. PATENT DOCUMENTS

| | | | |
|---|---|---|---|
| 2,057,353 | A | 10/1936 | Whittemore, Jr. |
| 2,809,634 | A | 10/1957 | Hirotada |
| 2,937,648 | A | 5/1960 | Meyer |
| 2,991,788 | A | 7/1961 | Brost |
| 3,111,396 | A | 11/1963 | Ball |

(Continued)

FOREIGN PATENT DOCUMENTS

| | | | |
|---|---|---|---|
| AT | 508244 | A4 | 12/2010 |
| AU | 6393173 | A | 6/1975 |

(Continued)

OTHER PUBLICATIONS

"Cambridge Dictionary Sleeve Definition", available at <dictionary/Cambridge.org/dictionary/English/sleeve>, Feb. 9, 2019.

(Continued)

*Primary Examiner* — Eric Yaary

(74) *Attorney, Agent, or Firm* — Womble Bond Dickinson (US) LLP

(57) ABSTRACT

An electronic vapor provision device comprising a power cell and a vaporizer, wherein the vaporizer comprises a heater and a heater support, wherein the heater is one the inside of the heater support.

9 Claims, 6 Drawing Sheets

(56) References Cited

U.S. PATENT DOCUMENTS 3,148,996 A 9/1964 Vukasovich et al.
3,239,117 A 3/1966 Letchworth
3,402,724 A 9/1968 Blount et al.
3,431,393 A 3/1969 Katsuda
3,433,632 A 3/1969 Elbert et al.
3,521,643 A 7/1970 Toth
3,604,428 A 9/1971 Moukaddem
3,804,100 A 4/1974 Fariello
3,844,199 A 10/1974 Block et al.
3,964,902 A 6/1976 Fletcher et al.
4,009,713 A 3/1977 Simmons et al.
4,031,906 A 6/1977 Knapp
4,094,119 A 6/1978 Sullivan
4,145,001 A 3/1979 Weyenberg et al.
4,161,283 A 7/1979 Hyman
4,193,513 A 3/1980 Bull
4,219,031 A 8/1980 Full et al.
4,503,851 A 3/1985 Braunroth
4,588,976 A 5/1986 Jaselli
4,676,237 A 6/1987 Wood et al.
4,735,217 A 4/1988 Gerth et al.
4,827,950 A 5/1989 Banerjee et al.
4,830,028 A 5/1989 Lawson et al.
4,846,199 A 7/1989 Rose
4,848,374 A 7/1989 Chard et al.
4,885,129 A 12/1989 Leonard et al.
4,917,301 A 4/1990 Munteanu
4,922,901 A 5/1990 Brooks et al.
4,924,886 A 5/1990 Litzinger
4,947,874 A 8/1990 Brooks et al.
4,947,875 A 8/1990 Brooks et al.
4,978,814 A 12/1990 Honour
5,027,837 A 7/1991 Clearman et al.
5,046,514 A 9/1991 Bolt
5,060,671 A 10/1991 Counts et al.
5,065,776 A 11/1991 Lawson et al.
5,095,647 A 3/1992 Zobele et al.
5,095,921 A 3/1992 Losee et al.
5,099,861 A 3/1992 Clearman et al.
5,115,823 A 5/1992 Keritsis
5,121,881 A 6/1992 Lembeck
5,129,409 A 7/1992 White et al.
5,144,962 A 9/1992 Counts et al.
5,167,242 A 12/1992 Turner et al.
5,179,966 A 1/1993 Losee et al.
5,247,947 A 9/1993 Clearman et al.
5,322,075 A 6/1994 Deevi et al.
5,369,723 A 11/1994 Counts et al.
5,388,574 A 2/1995 Ingebrethsen
5,390,864 A 2/1995 Alexander
5,415,186 A 5/1995 Casey et al.
5,415,486 A 5/1995 Wouters et al.
5,479,948 A 1/1996 Counts et al.
5,497,792 A 3/1996 Prasad et al.
5,501,236 A 3/1996 Hill et al.
5,505,214 A 4/1996 Collins et al.
5,540,241 A 7/1996 Kim
5,553,791 A 9/1996 Alexander
5,611,360 A 3/1997 Tang
5,636,787 A 6/1997 Gowhari
5,649,554 A 7/1997 Sprinkel et al.
5,666,977 A 9/1997 Higgins et al.
5,692,291 A 12/1997 Deevi et al.
5,692,526 A 12/1997 Adams et al.
5,743,251 A 4/1998 Howell et al.
5,865,185 A 2/1999 Collins et al.
5,954,060 A 9/1999 Cardarelli
6,095,505 A 8/2000 Miller
6,155,268 A 12/2000 Takeuchi
6,275,650 B1 8/2001 Lambert
6,280,793 B1 8/2001 Atwell et al.
6,532,965 B1 3/2003 Abhulimen et al.
6,652,804 B1 11/2003 Neumann et al.
6,681,998 B2 1/2004 Sharpe et al.
6,701,921 B2 3/2004 Sprinkel et al.
6,790,496 B1 9/2004 Levander et al.
7,100,618 B2 9/2006 Dominguez
7,112,712 B1 9/2006 Ancell
7,263,228 B2 8/2007 Mori
7,400,940 B2 7/2008 Mcrae et al.
7,540,286 B2 6/2009 Cross et al.
7,767,698 B2 8/2010 Warchol et al.
7,832,410 B2 11/2010 Hon
7,992,554 B2 8/2011 Radomski et al.
8,156,944 B2 4/2012 Han
8,205,622 B2 6/2012 Pan
8,365,742 B2 2/2013 Hon
8,375,957 B2 2/2013 Hon
8,393,331 B2 3/2013 Hon
8,430,106 B2 4/2013 Potter et al.
8,490,628 B2 7/2013 Hon
8,511,318 B2 8/2013 Hon
8,689,805 B2 4/2014 Hon
8,752,545 B2 6/2014 Buchberger
8,833,364 B2 9/2014 Buchberger
8,948,578 B2 2/2015 Buchberger
8,975,764 B1 3/2015 Abehasera
9,623,205 B2 4/2017 Buchberger
9,943,108 B2 4/2018 Lord
9,974,335 B2 5/2018 Lord
10,111,466 B2 10/2018 Lord
10,278,421 B2 5/2019 Lord
10,582,729 B2 3/2020 Lord
10,588,354 B2 3/2020 Lord
2001/0042546 A1 11/2001 Umeda et al.
2002/0016370 A1 2/2002 Shytle et al.
2002/0079309 A1 6/2002 Cox et al.
2003/0005620 A1 1/2003 Ananth et al.
2003/0049025 A1 3/2003 Neumann et al.
2003/0063902 A1 4/2003 Pedrotti et al.
2003/0079309 A1 5/2003 Vandenbelt et al.
2003/0106552 A1 6/2003 Sprinkel et al.
2003/0200964 A1 10/2003 Blakley et al.
2004/0031485 A1 2/2004 Rustad et al.
2004/0065749 A1 4/2004 Kotary et al.
2004/0129793 A1 7/2004 Nguyen et al.
2004/0151598 A1 8/2004 Young et al.
2005/0204799 A1 9/2005 Koch
2005/0268911 A1 12/2005 Cross et al.
2006/0078477 A1 4/2006 Althouse et al.
2006/0131439 A1 6/2006 Lakatos et al.
2007/0014549 A1 1/2007 Demarest et al.
2007/0062548 A1 3/2007 Horstmann et al.
2007/0102013 A1 5/2007 Adams et al.
2007/0107879 A1 5/2007 Radomski et al.
2007/0137667 A1 6/2007 Zhuang et al.
2007/0155255 A1 7/2007 Galauner et al.
2007/0283972 A1 12/2007 Monsees et al.
2008/0092912 A1 4/2008 Robinson et al.
2008/0216828 A1 9/2008 Wensley et al.
2008/0241255 A1 10/2008 Rose et al.
2009/0095311 A1 4/2009 Han
2009/0188490 A1 7/2009 Han
2009/0272379 A1 11/2009 Thorens et al.
2009/0288668 A1 11/2009 Inagaki
2009/0293888 A1 12/2009 Williams et al.
2009/0293892 A1 12/2009 Williams et al.
2009/0302019 A1 12/2009 Selenski et al.
2010/0006113 A1 1/2010 Urtsev et al.
2010/0024834 A1 2/2010 Oglesby et al.
2010/0059070 A1 3/2010 Potter et al.
2010/0065653 A1 3/2010 Wingo et al.
2010/0083959 A1 4/2010 Siller
2010/0108059 A1 5/2010 Axelsson et al.
2010/0236546 A1 9/2010 Yamada et al.
2011/0005535 A1 1/2011 Xiu
2011/0011396 A1 1/2011 Fang
2011/0036363 A1 2/2011 Urtsev et al.
2011/0094523 A1* 4/2011 Thorens ..... H05B 1/0244
131/194
2011/0126848 A1 6/2011 Zuber et al.
2011/0155153 A1 6/2011 Thorens et al.
2011/0168194 A1 7/2011 Hon
2011/0209717 A1 9/2011 Han

(56) References Cited

U.S. PATENT DOCUMENTS

| | | | |
|---|---|---|---|
| 2011/0226236 | A1 | 9/2011 | Buchberger |
| 2011/0232654 | A1 | 9/2011 | Mass |
| 2011/0277756 | A1 | 11/2011 | Terry et al. |
| 2011/0277757 | A1 | 11/2011 | Terry et al. |
| 2011/0290267 | A1 | 12/2011 | Yamada et al. |
| 2011/0297166 | A1 | 12/2011 | Takeuchi et al. |
| 2011/0303231 | A1 | 12/2011 | Li et al. |
| 2012/0006343 | A1 | 1/2012 | Renaud et al. |
| 2012/0111347 | A1 | 5/2012 | Hon |
| 2012/0145169 | A1 | 6/2012 | Wu |
| 2012/0179512 | A1 | 7/2012 | Okeeffe |
| 2012/0227753 | A1 | 9/2012 | Newton |
| 2012/0234821 | A1 | 9/2012 | Shimizu |
| 2012/0255567 | A1 | 10/2012 | Rose et al. |
| 2012/0260927 | A1 | 10/2012 | Liu |
| 2012/0279512 | A1 | 11/2012 | Hon |
| 2012/0285475 | A1 | 11/2012 | Liu |
| 2012/0285476 | A1 | 11/2012 | Hon |
| 2013/0037041 | A1 | 2/2013 | Worm et al. |
| 2013/0056013 | A1 | 3/2013 | Terry et al. |
| 2013/0074857 | A1 | 3/2013 | Buchberger |
| 2013/0081619 | A1 | 4/2013 | Seakins et al. |
| 2013/0081623 | A1 | 4/2013 | Buchberger |
| 2013/0192615 | A1 | 8/2013 | Tucker et al. |
| 2013/0192623 | A1 | 8/2013 | Tucker et al. |
| 2013/0213417 | A1 | 8/2013 | Chong et al. |
| 2013/0213419 | A1 | 8/2013 | Tucker et al. |
| 2013/0284192 | A1 | 10/2013 | Peleg et al. |
| 2013/0298905 | A1 | 11/2013 | Levin et al. |
| 2013/0306085 | A1 | 11/2013 | Sanchez et al. |
| 2013/0333700 | A1 | 12/2013 | Buchberger |
| 2013/0340779 | A1 | 12/2013 | Liu |
| 2014/0000638 | A1 | 1/2014 | Sebastian et al. |
| 2014/0007863 | A1 | 1/2014 | Chen |
| 2014/0024834 | A1 | 1/2014 | Mergelsberg et al. |
| 2014/0060528 | A1 | 3/2014 | Liu |
| 2014/0060529 | A1 | 3/2014 | Zhang |
| 2014/0060554 | A1 | 3/2014 | Collett et al. |
| 2014/0060555 | A1 | 3/2014 | Chang et al. |
| 2014/0069444 | A1 | 3/2014 | Cyphert et al. |
| 2014/0202454 | A1 | 7/2014 | Buchberger |
| 2014/0209105 | A1 | 7/2014 | Sears et al. |
| 2014/0238396 | A1 | 8/2014 | Buchberger |
| 2014/0238423 | A1 | 8/2014 | Tucker et al. |
| 2014/0238424 | A1 | 8/2014 | Macko et al. |
| 2014/0261490 | A1 | 9/2014 | Kane |
| 2014/0270730 | A1 | 9/2014 | Depiano et al. |
| 2014/0283825 | A1 | 9/2014 | Buchberger |
| 2014/0286630 | A1 | 9/2014 | Buchberger |
| 2014/0299125 | A1 | 10/2014 | Buchberger |
| 2014/0299142 | A1 | 10/2014 | Dincer et al. |
| 2014/0338680 | A1 | 11/2014 | Abramov et al. |
| 2015/0020831 | A1 | 1/2015 | Weigensberg et al. |
| 2015/0114411 | A1 | 4/2015 | Buchberger |
| 2015/0150302 | A1 | 6/2015 | Metrangolo et al. |
| 2015/0157055 | A1 | 6/2015 | Lord |
| 2015/0196058 | A1 | 7/2015 | Lord |
| 2015/0201675 | A1 | 7/2015 | Lord |
| 2015/0208728 | A1 | 7/2015 | Lord |
| 2015/0245654 | A1 | 9/2015 | Memari et al. |
| 2015/0258288 | A1 | 9/2015 | Sullivan |
| 2015/0333552 | A1 | 11/2015 | Alarcon |
| 2015/0333561 | A1 | 11/2015 | Alarcon |
| 2016/0073693 | A1 | 3/2016 | Reevell |
| 2016/0106154 | A1 | 4/2016 | Lord |
| 2016/0106155 | A1 | 4/2016 | Reevell |
| 2016/0250201 | A1 | 9/2016 | Rose et al. |
| 2016/0278436 | A1 | 9/2016 | Verleur et al. |
| 2016/0295923 | A1 | 10/2016 | Lin |
| 2016/0353804 | A1 | 12/2016 | Lord |
| 2017/0042245 | A1 | 2/2017 | Buchberger et al. |
| 2017/0114965 | A1 | 4/2017 | Maglica et al. |
| 2017/0143042 | A1 | 5/2017 | Batista et al. |
| 2017/0173278 | A1 | 6/2017 | Buchberger |
| 2017/0197043 | A1 | 7/2017 | Buchberger |
| 2017/0197044 | A1 | 7/2017 | Buchberger |
| 2017/0197046 | A1 | 7/2017 | Buchberger |
| 2017/0208865 | A1 | 7/2017 | Nettenstrom et al. |
| 2017/0251725 | A1 | 9/2017 | Buchberger et al. |
| 2018/0192705 | A1 | 7/2018 | Lord |
| 2018/0199618 | A1 | 7/2018 | Fuisz et al. |
| 2018/0235284 | A1 | 8/2018 | Lord |
| 2021/0100285 | A1 | 4/2021 | Spencer et al. |

FOREIGN PATENT DOCUMENTS

| | | | | |
|---|---|---|---|---|
| CA | 2309376 | A1 | | 11/2000 |
| CA | 2864238 | A1 | | 8/2013 |
| CA | 103974639 | A | | 8/2014 |
| CH | 698603 | B1 | | 9/2009 |
| CN | 1040496 | A | | 3/1990 |
| CN | 2082939 | U | | 8/1991 |
| CN | 2092880 | U | | 1/1992 |
| CN | 2220168 | Y | | 2/1996 |
| CN | 2249068 | Y | | 3/1997 |
| CN | 1205849 | A | | 1/1999 |
| CN | 2719043 | Y | | 8/2005 |
| CN | 1925757 | A | | 3/2007 |
| CN | 201054977 | Y | | 5/2008 |
| CN | 201079011 | Y | | 7/2008 |
| CN | 101277623 | A | | 10/2008 |
| CN | 201238609 | Y | | 5/2009 |
| CN | 101500443 | A | | 8/2009 |
| CN | 201375023 | Y | | 1/2010 |
| CN | 201379072 | Y | | 1/2010 |
| CN | 201468000 | U | | 5/2010 |
| CN | 101795505 | A | | 8/2010 |
| CN | 101843368 | A | * | 9/2010 |
| CN | 101878958 | A | | 11/2010 |
| CN | 202085723 | U | | 12/2011 |
| CN | 202172846 | U | | 3/2012 |
| CN | 102655773 | A | | 9/2012 |
| CN | 202722498 | U | | 2/2013 |
| CN | 202750708 | U | | 2/2013 |
| CN | 103070472 | A | | 5/2013 |
| CN | 203168033 | U | | 9/2013 |
| CN | 103750573 | A | | 4/2014 |
| CN | 103929988 | A | | 7/2014 |
| CN | 103974369 | A | | 8/2014 |
| CN | 104095293 | A | | 10/2014 |
| CN | 203943069 | U | | 11/2014 |
| CN | 204120237 | U | | 1/2015 |
| CN | 104349687 | A | | 2/2015 |
| CN | 106102863 | A | | 11/2016 |
| DE | 822964 | C | | 11/1951 |
| DE | 1950439 | A1 | | 4/1971 |
| DE | 3148335 | A1 | | 7/1983 |
| DE | 3218760 | A1 | | 12/1983 |
| DE | 3844022 | C1 | | 2/1990 |
| DE | 3936687 | A1 | | 5/1990 |
| DE | 29713866 | U1 | | 10/1997 |
| DE | 19630619 | A1 | | 2/1998 |
| DE | 19654945 | A1 | | 3/1998 |
| DE | 10330681 | B3 | | 6/2004 |
| DE | 202006013439 | U1 | | 10/2006 |
| DE | 102006004484 | A1 | | 8/2007 |
| DE | 102007011120 | A1 | | 9/2008 |
| DE | 202013100606 | U1 | | 2/2013 |
| EA | 015651 | B1 | | 10/2011 |
| EA | 201100197 | A1 | | 3/2012 |
| EP | 0280262 | A2 | | 8/1988 |
| EP | 0295122 | A2 | | 12/1988 |
| EP | 0358002 | A2 | | 3/1990 |
| EP | 0444553 | A2 | | 9/1991 |
| EP | 0488488 | A1 | | 6/1992 |
| EP | 0532194 | A1 | | 3/1993 |
| EP | 0712584 | A2 | | 5/1996 |
| EP | 0845220 | A1 | | 6/1998 |
| EP | 0893071 | A1 | | 1/1999 |
| EP | 1166814 | A2 | | 1/2002 |
| EP | 1166847 | A2 | | 1/2002 |
| EP | 1283062 | A1 | | 2/2003 |
| EP | 0845220 | B1 | | 9/2003 |
| EP | 1486226 | A2 | | 12/2004 |

(56) References Cited

FOREIGN PATENT DOCUMENTS

| | | | |
|---|---|---|---|
| EP | 1736065 | A1 | 12/2006 |
| EP | 2018886 | A1 | 1/2009 |
| EP | 2022349 | A1 | 2/2009 |
| EP | 1736065 | B1 | 6/2009 |
| EP | 2113178 | A1 | 11/2009 |
| EP | 2119375 | A1 | 11/2009 |
| EP | 2327318 | A1 | 6/2011 |
| EP | 2340729 | A1 | 7/2011 |
| EP | 2394520 | A1 | 12/2011 |
| EP | 2404515 | A1 | 1/2012 |
| EP | 2444112 | A1 | 4/2012 |
| EP | 2444411 | A1 | 4/2012 |
| EP | 2695531 | A1 | 2/2014 |
| EP | 2698070 | A1 | 2/2014 |
| EP | 2762019 | A1 | 8/2014 |
| EP | 2835062 | A1 | 2/2015 |
| EP | 2939553 | A1 | 11/2015 |
| EP | 2083643 | B1 | 9/2017 |
| FR | 960469 | A | 4/1950 |
| GB | 25575 | | 3/1912 |
| GB | 1313525 | A | 4/1973 |
| GB | 2333466 | A | 7/1999 |
| GB | 2488257 | A | 8/2012 |
| GB | 2496105 | A | 5/2013 |
| HK | 1196511 | A1 | 12/2014 |
| HK | 1226611 | A | 10/2017 |
| JP | S5130900 | U | 3/1976 |
| JP | S5752456 | A | 3/1982 |
| JP | S59106340 | A | 6/1984 |
| JP | S6196763 | A | 5/1986 |
| JP | S6196765 | A | 5/1986 |
| JP | H02124081 | A | 5/1990 |
| JP | H0339077 | A | 2/1991 |
| JP | H05103836 | A | 4/1993 |
| JP | H05309136 | A | 11/1993 |
| JP | H06315366 | A | 11/1994 |
| JP | H07502188 | A | 3/1995 |
| JP | H0878142 | A | 3/1996 |
| JP | H08299862 | A | 11/1996 |
| JP | H1189551 | A | 4/1999 |
| JP | H11507234 | A | 6/1999 |
| JP | 2002527153 | A | 8/2002 |
| JP | 3392138 | B2 | 3/2003 |
| JP | 2004332069 | A | 11/2004 |
| JP | 2005537918 | A | 12/2005 |
| JP | 2006504431 | A | 2/2006 |
| JP | 2007259864 | A | 10/2007 |
| JP | 2007267749 | A | 10/2007 |
| JP | 2009502136 | A | 1/2009 |
| JP | 2009504431 | A | 2/2009 |
| JP | 3153675 | U | 9/2009 |
| JP | 2009537119 | A | 10/2009 |
| JP | 2010520742 | A | 6/2010 |
| JP | 3164992 | U | 12/2010 |
| JP | 2011518567 | A | 6/2011 |
| JP | 2012517229 | A | 8/2012 |
| JP | 5130900 | B2 | 1/2013 |
| JP | 2013545473 | A | 12/2013 |
| JP | 2014076065 | A | 5/2014 |
| JP | 2014525237 | A | 9/2014 |
| JP | 2015506170 | A | 3/2015 |
| JP | 2015524257 | A | 8/2015 |
| KR | 20050037919 | A | 4/2005 |
| KR | 20110006928 | A | 1/2011 |
| KR | 20110006928 | U | 7/2011 |
| KR | 101081481 | B1 | 11/2011 |
| RU | 2004116065 | A | 6/2005 |
| RU | 2311859 | C2 | 12/2007 |
| RU | 2336001 | C2 | 10/2008 |
| RU | 89927 | U1 | 12/2009 |
| RU | 94815 | U1 | 6/2010 |
| RU | 103281 | U1 | 4/2011 |
| RU | 2420290 | C2 | 6/2011 |
| RU | 110608 | U1 | 11/2011 |
| RU | 115629 | U1 | 5/2012 |
| RU | 122000 | U1 | 11/2012 |
| RU | 124120 | U1 | 1/2013 |
| RU | 2480485 | C2 | 4/2013 |
| RU | 145715 | U1 | 9/2014 |
| RU | 158129 | U1 | 12/2015 |
| SU | 1641182 | A3 | 4/1991 |
| TW | 201225862 | A | 7/2012 |
| WO | 9406313 | A1 | 3/1994 |
| WO | 9502712 | A2 | 1/1995 |
| WO | 9527412 | A1 | 10/1995 |
| WO | 9632854 | A2 | 10/1996 |
| WO | 9639880 | A1 | 12/1996 |
| WO | 9748293 | A1 | 12/1997 |
| WO | 9836651 | A1 | 8/1998 |
| WO | 0009188 | A1 | 2/2000 |
| WO | 0021598 | A1 | 4/2000 |
| WO | 02058747 | A1 | 8/2002 |
| WO | 2002061701 | A1 | 8/2002 |
| WO | 03028409 | A1 | 4/2003 |
| WO | 03050405 | A1 | 6/2003 |
| WO | 03083283 | A1 | 10/2003 |
| WO | 03101454 | A1 | 12/2003 |
| WO | 2004022128 | A2 | 3/2004 |
| WO | 2004022242 | A1 | 3/2004 |
| WO | 2004022243 | A1 | 3/2004 |
| WO | 2004080216 | A1 | 9/2004 |
| WO | 2005106350 | A2 | 11/2005 |
| WO | 2006048774 | A1 | 5/2006 |
| WO | 2006082571 | A1 | 8/2006 |
| WO | 2006124757 | A2 | 11/2006 |
| WO | 2007012007 | A2 | 1/2007 |
| WO | 2007042941 | A2 | 4/2007 |
| WO | 2007078273 | A1 | 7/2007 |
| WO | 2007131449 | A1 | 11/2007 |
| WO | 2008015441 | A1 | 2/2008 |
| WO | 2008029381 | A2 | 3/2008 |
| WO | 2009015410 | A1 | 2/2009 |
| WO | 2009022232 | A2 | 2/2009 |
| WO | 2009132793 | A1 | 11/2009 |
| WO | 2010045670 | A1 | 4/2010 |
| WO | 2010045671 | A1 | 4/2010 |
| WO | 2010091593 | A1 | 8/2010 |
| WO | 2011060788 | A1 | 5/2011 |
| WO | 2011079932 | A1 | 7/2011 |
| WO | 2011106788 | A2 | 9/2011 |
| WO | 2011107737 | A1 | 9/2011 |
| WO | 2011109849 | A1 | 9/2011 |
| WO | 2011124033 | A1 | 10/2011 |
| WO | 2011137453 | A2 | 11/2011 |
| WO | 2011146372 | A2 | 11/2011 |
| WO | 2011160788 | A1 | 12/2011 |
| WO | 2012025496 | A1 | 3/2012 |
| WO | 2012072264 | A1 | 6/2012 |
| WO | 2012072762 | A1 | 6/2012 |
| WO | 2012156700 | A1 | 11/2012 |
| WO | 2013034453 | A1 | 3/2013 |
| WO | 2013034460 | A1 | 3/2013 |
| WO | 2013057185 | A1 | 4/2013 |
| WO | 2013060784 | A2 | 5/2013 |
| WO | 2013076098 | A2 | 5/2013 |
| WO | 2013082173 | A1 | 6/2013 |
| WO | 2013083631 | A1 | 6/2013 |
| WO | 2013083634 | A1 | 6/2013 |
| WO | 2013098395 | A1 | 7/2013 |
| WO | 2013116558 | A1 | 8/2013 |
| WO | 2013116571 | A1 | 8/2013 |
| WO | 2013148810 | A1 | 10/2013 |
| WO | 2013149404 | A1 | 10/2013 |
| WO | 2013178766 | A1 | 12/2013 |
| WO | 2014061477 | A1 | 4/2014 |
| WO | 2014104078 | A1 | 7/2014 |
| WO | 2014106093 | A1 | 7/2014 |
| WO | 2014130695 | A1 | 8/2014 |
| WO | 2014136872 | A1 | 9/2014 |
| WO | 2014140320 | A1 | 9/2014 |
| WO | 2014150131 | A1 | 9/2014 |
| WO | 2015117702 | A1 | 8/2015 |

(56) References Cited

FOREIGN PATENT DOCUMENTS

| | | | |
|---|---|---|---|
| WO | 2016156493 | A2 | 10/2016 |
| WO | 2016162446 | A1 | 10/2016 |
| WO | 2017055866 | A1 | 4/2017 |

OTHER PUBLICATIONS

"Canada Office Action, Application No. 2,878,973, mailed Jan. 22, 2016".
"Canadian Office Action, Application No. 2,878,959, dated Jan. 18, 2016".
"Chinese First Office Action for Chinese Application No. 200980152395.4 date issued Dec. 3, 2012".
"Chinese Office Action and Chinese Search Report, Chinese Application No. CN201680020844.X, mailed Jun. 24, 2019".
"Chinese Office Action and Search Report, Chinese Application No. 201680020842.0, mailed Jun. 21, 2019".
"Chinese Office Action, Application No. 201680020844.X, dated Jul. 2, 2019".
"Chinese Office Action, Chinese Application No. 201380038055.5, dated Jul. 11, 2017".
"Chinese Office Action, Chinese Application No. 201380038055.5, mailed on Apr. 18, 2016".
"Chinese Office Action, Chinese Application No. 201680020758.9, mailed Jul. 23, 2019".
"Chinese Second Office Action and Search Report, Application No. 201680020844.X, dated May 22, 2020".
"Communication pursuant to Article 94(3) EPC for European Application No. 16189742.6, mailed on Dec. 4, 2020".
"Decision to Grant in Russian Application No. 2014120213, dated Oct. 26, 2016".
"Decision to Grant mailed Oct. 24, 2019 for Russian Application No. 2019118770".
"European Extended Search Report, Application No. 18195423.1, dated Jan. 29, 2019".
"European Notice of Opposition, Application No. EP2871984, dated Jun. 6, 2017".
"European Search Report for European Application No. 16189742.6 mailed Mar. 17, 2017".
"European Search Report received for European Patent Application No. 16166656.5 dated Oct. 11, 2016".
"Exam Report from European Application 16189742.6-1006, dated Dec. 19, 2019".
"Examination Report for Australian Application No. 2015293686, dated Jul. 25, 2018".
"Examination Report for European Application No. 15741289.1, dated Jun. 15, 2018".
"Extended European Search Report for Application No. 16177005.2, mailed on Oct. 26, 2016".
"Extended European Search Report for European Application No. 15178588.8, mailed on Apr. 22, 2016".
"Extended European Search Report received for European Patent Application No. 17189951.1, mailed on Jan. 4, 2018".
"Extended European Search Report, European Application No. 19174777.3, mailed Nov. 11, 2019".
"GB Search Report, Application No. GB1505593.2, mailed Sep. 22, 2015,".
"GB Search Report, GB Application No. GB1505595.7, mailed Oct. 20, 2015".
"International Preliminary Report on Patentability for Appl. No. PCT/EP2016/057064, mailed on Oct. 12, 2017".
"International Preliminary Report on Patentability for Application No. PCT/AT2012/000017, issued on Aug. 13, 2013".
"International Preliminary Report on Patentability for Application No. PCT/EP2012/070647, mailed on May 1, 2014".
"International Preliminary Report on Patentability for Application No. PCT/EP2016/057060, mailed on Jul. 12, 2017".
"International Preliminary Report on Patentability for Application No. PCT/EP2016/057097, mailed on Oct. 12, 2017".
"International Preliminary Report on Patentability for Application No. PCT/GB2014/051332, mailed on Nov. 12, 2015".
"International Preliminary Report on Patentability for Application No. PCT/GB2014/051333, completed on Aug. 5, 2015".
"International Preliminary Report on Patentability for Application No. PCT/GB2014/051334, mailed on Nov. 12, 2015".
"International Preliminary Report on Patentability for corresponding International Application No. PCT/GB2015/051213 mailed on Jul. 14, 2016".
"International Preliminary Report on Patentability, mailed Oct. 27, 2014, for Application No. PCT/EP2013/064952, filed Jul. 15, 2013".
"International Preliminary Report on Patentability, mailed Oct. 31, 2014, for Application No. PCT/EP2013/064950, filed Jul. 15, 2013.".
"International Search Report and Written Opinion for Application No. PCT/EP2016/057097, mailed on Sep. 28, 2016".
"International Search Report and Written Opinion received for PCT Application No. PCT/EP2012/003103, mailed on Nov. 26, 2012".
"International Search Report and Written Opinion received for PCT Application No. PCT/GB2014/051333, mailed on Jul. 17, 2014".
"International Search Report and Written Opinion received for PCT Application No. PCT/GB2014/051334 mailed Jul. 21, 2014".
"International Search Report and Written Opinion received for PCT Patent Application No. PCT/GB2014/051332, mailed on Jul. 21, 2014".
"International Search Report and Written Opinion received for PCT Patent Application No. PCT/EP2012/070647, mailed on Feb. 6, 2013".
"International Search Report and Written Opinion received for PCT Patent Application No. PCT/AT2012/000017, mailed on Jul. 3, 2012".
"International Search Report and Written Opinion, mailed Dec. 2, 2013, for Application No. PCT/EP2013/064950, filed Jul. 15, 2013".
"International Search Report and Written Opinion, mailed Oct. 11, 2013, for Application No. PCT/EP2013/064952, filed Jul. 15, 2013".
"International Search Report and Written Opinion, PCT Application No. PCT/EP2016/057064, mailed Oct. 19, 2016".
"International Search Report for corresponding International Application No. PCT/GB2015/051213 mailed on Jul. 16, 2015".
"International Search Report received for PCT Patent Application No. PCT/AT2009/000413 mailed on Jan. 25, 2010".
"International Search Report received for PCT Patent Application No. PCT/AT2009/000414 mailed on Jan. 26, 2010".
"International Search Report, International Application No. PCT/EP2016/057060, mailed Sep. 28, 2016".
"Japanese Office Action for Japanese Application No. 2015-522066 dated Dec. 8, 2015".
"Japanese Office Action, Application No. 2015-522066, dated Jan. 5, 2016".
"Japanese Office Action, Application No. 2015-522064, dated Jan. 5, 2015".
"Japanese Office Action, Application No. 2017-551218, dated Oct. 30, 2018".
"Japanese Office Action, Application No. 2019-124231, mailed Oct. 27, 2020".
"Japanese Office Action, Japanese Application No. 2015-522064, mailed Dec. 28, 2015".
"Japanese Office Action, Japanese Application No. 2017-551205, mailed Oct. 2, 2018".
"Japanese Office Action, Japanese Application No. 2017-551206, mailed Oct. 23, 2019".
"Japanese Office Action, Japanese Application No. 2017551218, mailed Aug. 6, 2019".
"Japanese Office Action, Japanese Application No. 2015-522065, dated Jan. 5, 2016".
"Korean Decision for Refusal for Korean Application No. KR2020110006928 dated Jan. 10, 2019".
"Korean Notice Trial Decision to Reject for Korean Application No. 10-2015-7001257 mailed Aug. 14, 2019".
"Korean Office Action, Application No. 10-2015-7001256, dated Sep. 7, 2016".
"Korean Office Action, Application No. 10-2015-7001257, dated Sep. 8, 2016".

(56) References Cited

OTHER PUBLICATIONS

"Korean Office Action, Application No. 10-2017-7034160, dated Jul. 18, 2018".
"Notice of Opposition Letter from EPO Opposition against for EP2358418 mailed on Mar. 1, 2017".
"Office Action dated Aug. 24, 2018 for Chinese Application No. 201580040255.3".
"Office Action for Canadian Application No. 2,954,848, dated Dec. 18, 2017".
"Office Action for Chinese Application No. 201811153475.9, mailed on Apr. 22, 2021".
"Office Action for Japanese Application No. 2017-504040, dated Feb. 22, 2018".
"Office Action for Japanese Application No. 2017-504040, dated Oct. 9, 2018".
"Office Action for Japanese Application No. 2018-206299, dated Apr. 13, 2021".
"Office Action for Japanese Application No. 2018-206299, dated Oct. 6, 2020".
"Office Action mailed Mar. 15, 2018 for Korean Application No. 2017-7002235".
"Office Action received for Chinese Patent Application No. 201480024988.3, mailed on Dec. 30, 2016".
"Office Action received for Chinese Patent Application No. 201480024978.X mailed on Jan. 18, 2017".
"Office Action received for Chinese Patent Application No. 201480024988.3, mailed on Sep. 11, 2017".
"Office Action received for Russian Patent Application No. 2015146847, mailed on Sep. 22, 2017".
"Reasons for Rejection received for Japanese Patent Application No. 2015-137361, mailed on May 31, 2016".
"Reasons for Rejection received for Japanese Patent Application No. 2011-532464, mailed on Oct. 7, 2013".
"Reasons for Rejection received for Japanese Patent Application No. 2014-179732, mailed on Sep. 8, 2015".
"Reasons for Rejection received for Japanese Patent Application No. 2016-134648 mailed May 23, 2017".
"Russian Decision to Grant for Russian Application No. 2015100878 dated Sep. 19, 2016".
"Russian Decision to Grant, Application No. 2015100881/12, dated Apr. 6, 2016".
"Russian Office Action, Russian Application No. 2018118998, mailed Sep. 24, 2018".
"Search Report mailed May 17, 2020 for Chinese Application No. 201680020844.X".
"Search Report mailed Jan. 15, 2018, for Japanese Application No. 2017-504040".
"Search Report received for Russian Patent Application No. 2015146843/12 (072088), mailed on Apr. 24, 2017".
"Search Report, GB Application No. GB1505597.3, mailed Oct. 7, 2015".
"Translation of Chinese Second Office Action for Chinese Application No. 200980152395.4 date issued Aug. 20, 2013".
"Written Opinion for Application No. PCT/EP2016/057060, mailed on Sep. 28, 2016".
"Written Opinion of the International Preliminary Examining Authority for International Application No. PCT/GB2015/051213 mailed on Mar. 29, 2016".
"Written Opinion, International Application No. PCT/EP2016/057060, mailed Apr. 7, 2017".
Aerosols , "Pulmonary Pharmacology: Delivery Devices and Medications", available at http://www.ceu.org/cecourses/z98107/ch4.htm , Sep. 6, 2017 , 2 pages.
Christopher, Lord , "Application and File History for U.S. Appl. No. 14/415,552, filed Jan. 16, 2015".
Christopher, Lord , "Application and File History for U.S. Appl. No. 15/959,687, filed Apr. 23, 2018".
Diener Electronic , "Plasma Technology", The Company Diener Electronic GmbH+Co. KG, www.plasma.de , Oct. 17, 2017 , 19 Pages.
Dunn , et al. , "Heat Pipes", 4th edition, ISBN 0080419038 , 1994 , 14 Pages.
Kynol , "Standard Specifications of Kynol Activated Carbon Fiber Products", published by Kynol , Sep. 19, 2013 , 2 pages.
Lord , et al. , "Application and File History for U.S. Appl. No. 14/415,540, filed Jan. 16, 2015".
Lord , et al. , "Application and File History for U.S. Appl. No. 15/914,139, filed Mar. 7, 2018".
Rudolph, G , "The Influence of CO2 on the Sensory Characteristics of the Favor-System", BAT Cigarettenfabriken GmbH, http://legacy.library.ucsf.edu/tid/sla51f00 , 24 pages.
Sutton , "Application and File History for U.S. Appl. No. 15/563,065, filed Sep. 29, 2017".
Sutton , et al. , "Application and File History for U.S. Appl. No. 15/563,078, filed Sep. 29, 2017".
Sutton , et al. , "Application and File History for U.S. Appl. No. 15/563,086, filed Sep. 29, 2017".
European Notice Of Opposition in European Application No. EP18195423.1, dated Feb. 28, 2024, 37 pages.
European Search Report and Written Opinion in International Appln. No. 23176770.8, dated Nov. 16, 2023, 28 pages.
Office Action For Russian Application No. 2020124363, mailed on Feb. 17, 2021, 3 pages.

* cited by examiner

ELECTRONIC VAPOR PROVISION DEVICE

RELATED APPLICATION

This application is a continuation of application Ser. No. 16/750,077, filed Jan. 23, 2020, which is a continuation of application Ser. No. 15/959,687, filed Apr. 23, 2018, now patented as U.S. Pat. No. 10,582,729, issued Mar. 10, 2022, which in turn is a divisional of application Ser. No. 14/415,540, filed Jan. 16, 2015, now patented as U.S. Pat. No. 9,974,335, issued May 22, 2018, which in turn is a National Phase entry of PCT Application No. PCT/EP2013/064950, filed Jul. 15, 2013, which claims the benefit of United Kingdom Application No. GB1212603.3, filed Jul. 16, 2012, each of which is hereby fully incorporated herein by reference.

TECHNICAL FIELD

The specification relates to electronic vapor provision devices.

BACKGROUND

Electronic vapor provision devices, such as electronic cigarettes, are typically cigarette-sized and typically function by allowing a user to inhale a nicotine vapor from a liquid store by applying a suction force to a mouthpiece. Some electronic vapor provision devices have an airflow sensor that activates when a user applies the suction force and causes a heater coil to heat up and vaporize the liquid.

SUMMARY

In an embodiment there is provided an electronic vapor provision device comprising a power cell and a vaporizer, where the vaporizer comprises a heating element and a heating element support, wherein the heating element is on the inside of the heating element support. One or more gaps may be provided between the heating element and the heating element support. Moreover, the electronic vapor provision device may have a mouthpiece section and the vaporizer may be part of the mouthpiece section. The heating element support may substantially fill the mouthpiece section.

In another embodiment there is provided a vaporizer for use in the vapor provision device, that comprises a heating element and a heating element support, wherein the heating element is on the inside of the heating element support.

In another embodiment there is provided an electronic vapor provision device comprising a liquid store; a wicking element configured to wick liquid from the liquid store to a heating element for vaporizing the liquid; an air outlet for vaporized liquid from the heating element; and a heating element support, wherein the heating element is on the inside of the heating element support. The heating element support may be the wicking element. Moreover, the electronic vapor provision device may include a power cell for powering the heating element.

BRIEF DESCRIPTION OF THE DRAWINGS

For a better understanding of the disclosure, and to show how example embodiments may be carried into effect, reference will now be made to the accompanying drawings in which.

DETAILED DESCRIPTION

Figure 1:
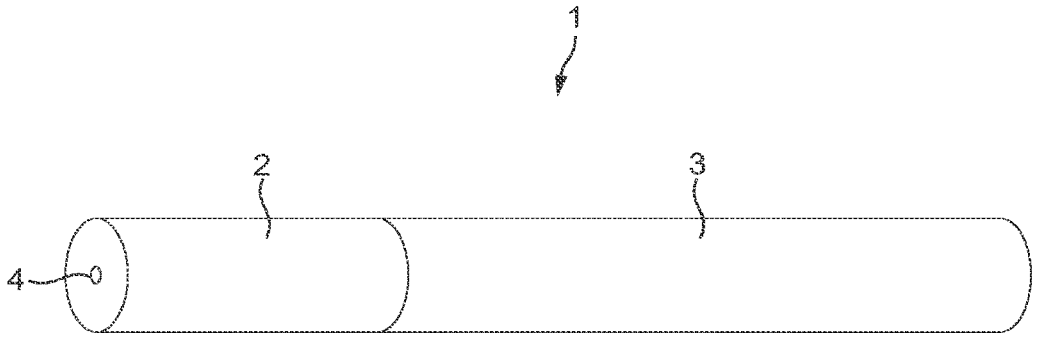
FIG. 1 is a side perspective view of an electronic cigarette.

In an embodiment there is provided an electronic vapor provision device comprising a power cell and a vaporizer, where the vaporizer comprises a heating element and a heating element support, wherein the heating element is on the inside of the heating element support. The electronic vapor provision device may be an electronic cigarette.

Having a separate heating element and support allows a finer heating element to be constructed. This is advantageous because a finer heating element can be more efficiently heated. Having the heating element on the inside of the support means that a much smaller and narrower heating element can be used since space is not needed inside the heating element to house a support. This enables a much larger and therefore stronger support to be used.

The heating element may not be supported on its inside. Having a heating element that is not supported on its inside means that a support does not interfere with the heating element on its inner region. This provides a greater heating element surface area which thereby increases the vaporization efficiency.

The heating element support may be a liquid store. A combined support and liquid store has the advantage that liquid can be easily transferred from the liquid store to the heating element supported by the liquid store. Also, by eliminating the need for a separate support, the device can be made smaller or a larger liquid store can be utilized for increased capacity.

One or more gaps may be provided between the heating element and the heating element support. Providing a gap between the heating element and the heating element support allows liquid to gather, and thereby be stored, in the gap region for vaporization. The gap can also act to wick liquid onto the heating element. Also, providing a gap between the heating element and support means that a greater surface area of the heating element is exposed thereby giving a greater surface area for heating and vaporization.

The heating element may be in contact with the heating element support at two or more locations. Moreover, the heating element may be in contact with the heating element support at points along the length of the support.

The heating element support may be a rigid and/or a solid support. Furthermore, the heating element support may be porous. For example, the heating element support may be formed of porous ceramic material.

The heating element support may be elongated in a lengthwise direction. Moreover, the heating element support may have a support channel and the heating element may be located in the support channel. Furthermore, the support channel may run in a lengthwise direction of the heating element support.

The support channel may be an internal support channel. Moreover, the support channel may be a central support channel. Alternatively, the support channel may be a side support channel, located on a side of the heating element support.

The support channel may be substantially cylindrical. Moreover, the cross-sectional shape of the support channel may be circular. Alternatively, the cross-sectional shape of the support channel may be a polygon. Furthermore, the cross-sectional shape of the support channel may have 4 sides, 6 sides or 8 sides. Cross-sections are sections perpendicular to the elongated lengthwise direction. These various shapes of support channel provide natural gaps between the support and a heating element coil within the support channel. These gaps lead to increased wicking, liquid storage and vaporization.

The heating element support may comprise a first support section and a second support section. Moreover, the heating element may be supported by the first support section and the second support section. For example, the heating element may be supported between the first support section and the second support section. Furthermore, the support channel may be provided between the first support section and the second support section and the heating element may be in the support channel. The first support section may provide a first side of the support channel and the second support section may provide a second side of the support channel.

Providing a support that comprises two separate sections provides an easier method of assembly. It also enables a more accurate and consistent positioning of the heating element relative to the support.

The heating element may run along the length of the support channel. Moreover, the heating element may be in contact with the support channel at points along the length of the support channel. The heating element may be in contact with the surface of the support channel along the length of the support channel.

The heating element may be a heating coil, such as a wire coil. The heating coil may be coiled so as to be supported along its length by the heating element support. The turns of the heating coil may be supported by the heating element support. The turns of the heating coil may be in contact with the heating element support. A gap may be provided between the heating coil and the heating element support. Moreover, the gap may be between a coil turn and heating element support. Furthermore, gaps may be between coil turns and the heating element support.

By providing a gap between a coil turn and the support, liquid can be wicked into the gap and held in the gap for vaporization. In particular, liquid can be wicked by the spaces between coil turns and into the gap between a coil turn and the support.

The vaporizer may have a vaporization cavity configured such that in use the vaporization cavity is a negative pressure region. At least part of the heating element may be inside the vaporization cavity, or the heating element may be entirely inside the vaporization cavity. For example, the vaporization cavity may be inside the heating element support. Moreover, the vaporization cavity may be inside a channel of the heating element support. At least part of the vaporization cavity may be inside the heating element.

By having the heating element in the vaporization cavity, which in turn is a negative pressure region when a user inhales through the electronic vapor provision device, the liquid is directly vaporized and inhaled by the user.

The electronic vapor provision device may further include a mouthpiece section and the vaporizer may be part of the mouthpiece section. Moreover, the heating element support may substantially fill the mouthpiece section.

The liquid store may not comprise an outer liquid store container.

Since the support is on the outside of the coil and can act as a liquid store, a liquid store container is not needed in addition to the liquid store, and the heating element support can fill the mouthpiece section to give greater storage capacity and a more efficient device.

The electronic vapor provision device may further include a heating element connecting wire and the heating element support may include a heating element connecting wire support section.

The heating element support may be substantially cylindrical. The outer cross-sectional shape of the heating element support may be a circle. Alternatively, the outer cross-sectional shape of the heating element support may be a polygon. The outer cross-sectional shape of the heating element support may have 4 sides.

Referring to FIG. 1 there is shown an embodiment of the electronic vapor provision device 1 in the form of an electronic cigarette 1 comprising a mouthpiece 2 and a body 3. The electronic cigarette 1 is shaped like a conventional cigarette having a cylindrical shape. The mouthpiece 2 has an air outlet 4 and the electronic cigarette 1 is operated when a user places the mouthpiece 2 of the electronic cigarette 1 in their mouth and inhales, drawing air through the air outlet 4. Both the mouthpiece 2 and body 3 are cylindrical and are configured to connect to each other coaxially so as to form the conventional cigarette shape.

Figure 2:
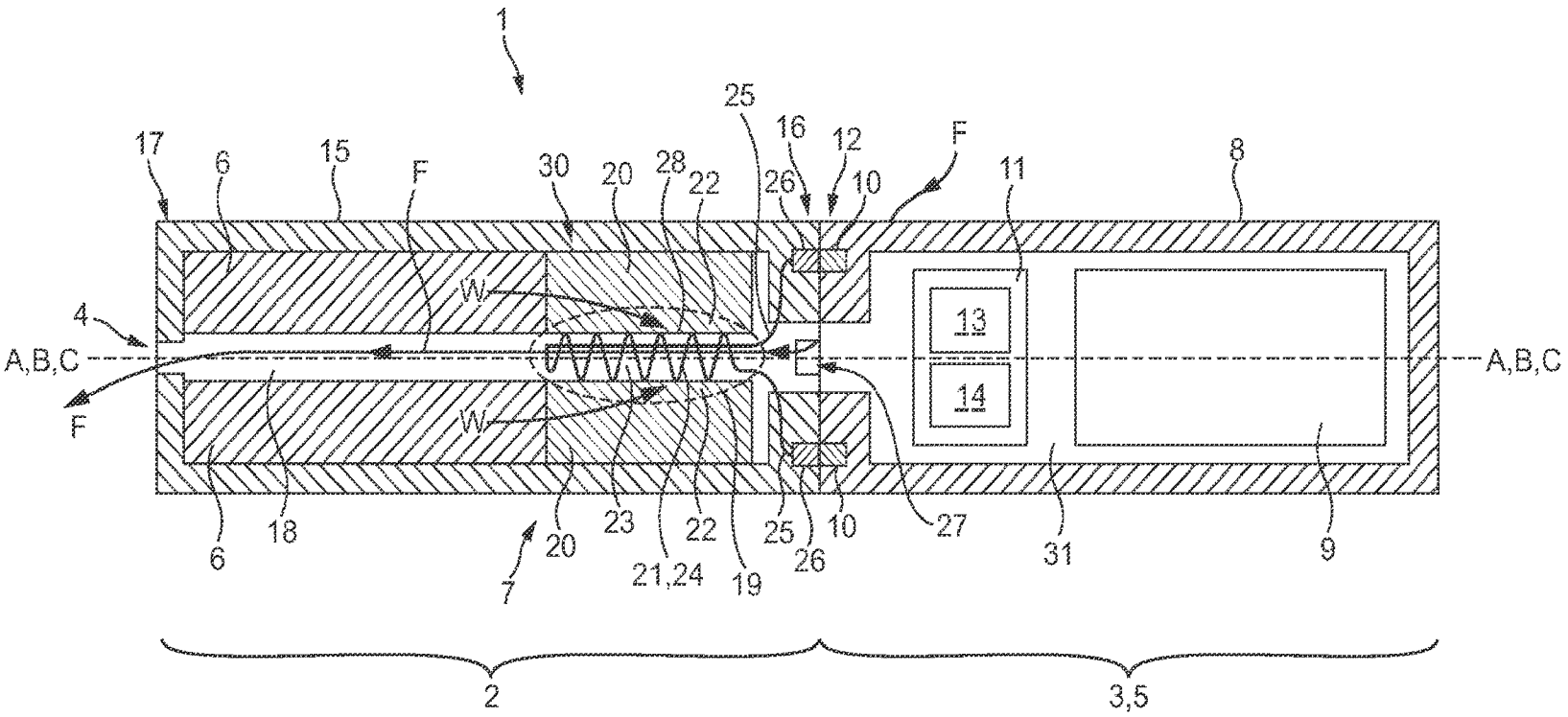
FIG. 2 is a schematic sectional view of an electronic cigarette having a parallel coil.
Figure 3:
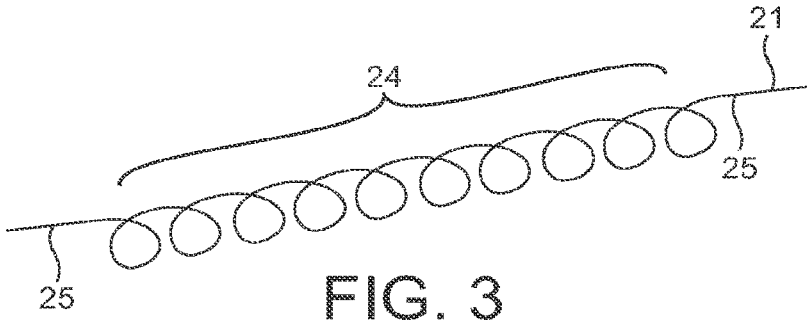
FIG. 3 is a side perspective view of a heating element coil.
Figure 4:
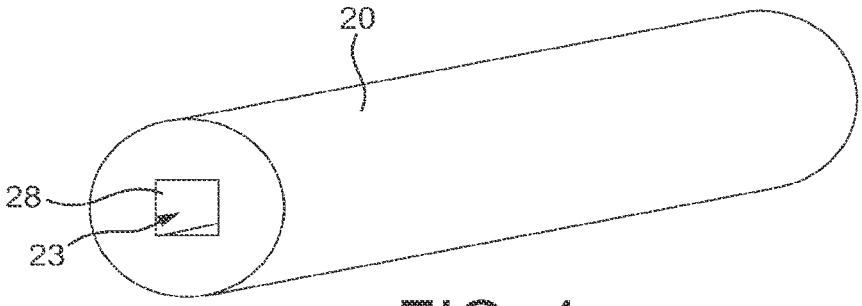
FIG. 4 is a side perspective view of an outer heating element support.

FIG. 2 shows an example of the electronic cigarette 1 of FIG. 1. The body 3 is referred to herein as a battery assembly 5, and the mouthpiece 2 includes a liquid store 6 and a vaporizer 7. The electronic cigarette 1 is shown in its assembled state, wherein the detachable parts 2, 5 are connected. Liquid wicks from the liquid store 6 to the vaporizer 7. The battery assembly 5 provides electrical power to the vaporizer 7 via mutual electrical contacts of the battery assembly 5 and the mouthpiece 2. The vaporizer 7 vaporizes the wicked liquid and the vapor passes out of the air outlet 4. The liquid may for example comprise a nicotine solution.

The battery assembly 5 comprises a battery assembly casing 8, a power cell 9, electrical contacts 10 and a control circuit 11.

The battery assembly casing 8 comprises a hollow cylinder which is open at a first end 12. For example, the battery assembly casing 8 may be plastic. The electrical contacts 10 are located at the first end 12 of the casing 8, and the power cell 9 and control circuit 11 are located within the hollow of the casing 8. The power cell 9 may for example be a Lithium Cell.

The control circuit 11 includes an air pressure sensor 13 and a controller 14 and is powered by the power cell 9. The controller 14 is configured to interface with the air pressure sensor 13 and to control provision of electrical power from the power cell 9 to the vaporizer 7, via the electrical contacts 10.

The mouthpiece 2 further includes a mouthpiece casing 15 and electrical contacts 26. The mouthpiece casing 15 comprises a hollow cylinder which is open at a first end 16, with the air outlet 4 comprising a hole in the second end 17 of the casing 15. The mouthpiece casing 15 also comprises an air inlet 27, comprising a hole near the first end 16 of the casing 15. For example, the mouthpiece casing may be formed of aluminum.

The electrical contacts 26 are located at the first end of the casing 15. Moreover, the first end 16 of the mouthpiece casing 15 is releasably connected to the first end 12 of the battery assembly casing 8, such that the electrical contacts 26 of the mouthpiece 2 are electrically connected to the electrical contacts 10 of the battery assembly 5. For example, the device 1 may be configured such that the mouthpiece casing 15 connects to the battery assembly casing 8 by a threaded connection.

The liquid store 6 is situated within the hollow mouthpiece casing 15 towards the second end 17 of the casing 15. The liquid store 6 comprises a cylindrical tube of porous material saturated in liquid. The outer circumference of the liquid store 6 matches the inner circumference of the mouthpiece casing 15. The hollow of the liquid store 6 provides an air passageway 18. For example, the porous material of the liquid store 6 may comprise foam, wherein the foam is substantially saturated in the liquid intended for vaporization.

The vaporizer 7 comprises a vaporization cavity 19, a heating element support 20 and a heating element 21.

The vaporization cavity 19 comprises a region within the hollow of the mouthpiece casing 15 in which liquid is vaporized. The heating element 21 and a portion 22 of the support 20 are situated within the vaporization cavity 19.

The heating element support 20 is configured to support the heating element 21 and to facilitate vaporization of liquid by the heating element 21. The heating element support 20 is an outer support and is illustrated in FIGS. 4 to 7. The support 20 comprises a hollow cylinder of rigid, porous material and is situated within the mouthpiece casing 15, towards the first end 16 of the casing 15, such that it abuts the liquid store 6. The outer circumference of the support 20 matches the inner circumference of the mouthpiece casing 15. The hollow of the support comprises a longitudinal, central channel 23 through the length of the support 20. The channel 23 has a square cross-sectional shape, the cross-section being perpendicular to the longitudinal axis of the support.

The support 20 acts as a wicking element, as it is configured to wick liquid in the direction W from the liquid store 6 of the mouthpiece 2 to the heating element 21. For example, the porous material of the support 20 may be nickel foam, wherein the porosity of the foam is such that the described wicking occurs. Once liquid wicks W from the liquid store 6 to the support 20, it is stored in the porous material of the support 20. Thus, the support 20 is an extension of the liquid store 6.

The heating element 21 is formed of a single wire and comprises a heating element coil 24 and two leads 25, as is illustrated in FIGS. 3, 5, 6 and 7. For example, the heating element 21 may be formed of Nichrome. The coil 24 comprises a section of the wire where the wire is formed into a helix about an axis A. At either end of the coil 24, the wire departs from its helical form to provide the leads 25. The leads 25 are connected to the electrical contacts 26 and are thereby configured to route electrical power, provided by the power cell 9, to the coil 24.

The wire of the coil 24 is approximately 0.12 mm in diameter. The coil is approximately 25 mm in length, has an internal diameter of approximately 1 mm and a helix pitch of approximately 420 micrometers. The void between the successive turns of the coil 24 is therefore approximately 300 micrometers.

The coil 24 of the heating element 21 is located coaxially within the channel 23 of the support. The heating element coil 24 is thus coiled within the channel 23 of the heating element support 20. Moreover, the axis A of the coil 24 is thus parallel to the cylindrical axis B of the mouthpiece casing 15 and the longitudinal axis C of the electronic cigarette 1. Moreover, the device 1 is configured such that the axis A of the coil 24 is substantially parallel to airflow F through the device when a user sucks on the device. Use of the device 1 by a user is later described in more detail.

Figure 5:
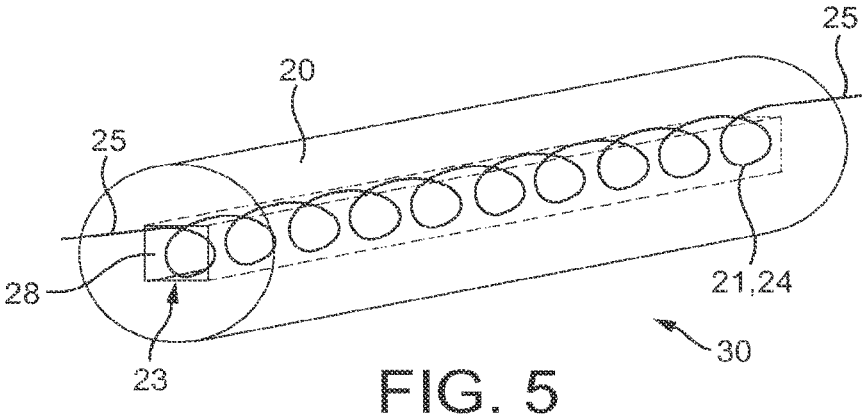
FIG. 5 is a side perspective view of a heating element coil within an outer heating element support.
Figure 6:
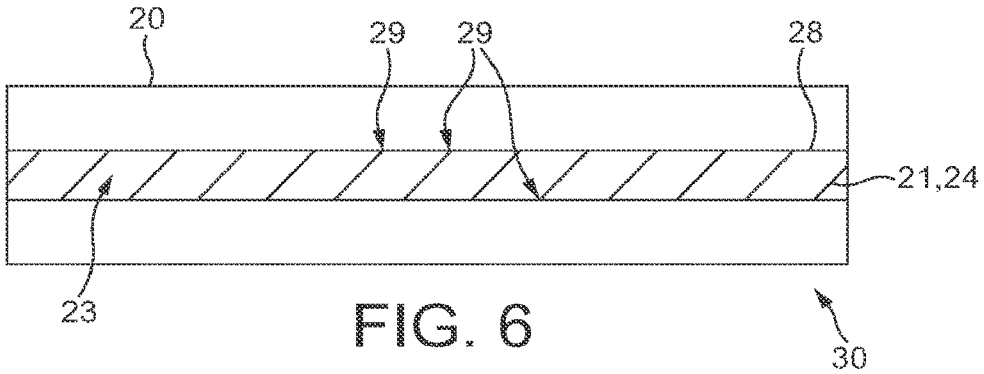
FIG. 6 is a side sectional view of a heating element coil within an outer heating element support.
Figure 7:
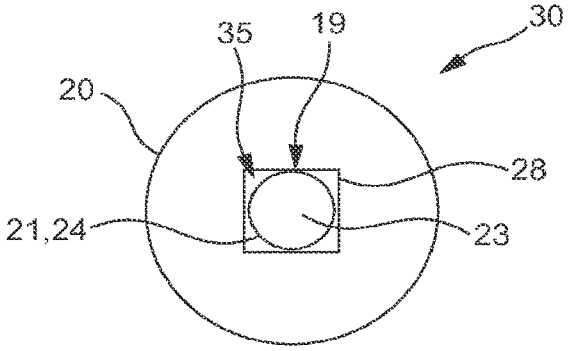
FIG. 7 is an end view of a heating element coil within an outer heating element support, where a central channel has a square cross-section.

The coil 24 is the same length as the support 20, such that the ends of the coil 24 are flush with the ends of the support 20. The outer diameter of the helix of the coil 24 is similar to the cross-sectional width of the channel 23. As a result, the wire of the coil 24 is in contact with the surface 28 of the channel 23 and is thereby supported, facilitating maintenance of the shape of the coil 24. Each turn of the coil is in contact with the surface 28 of the channel 23 at a contact point 29 on each of the four walls 28 of the channel 23. The combination of the coil 24 and the support 20 provides a heating rod 30, as illustrated in FIGS. 5, 6 and 7. The heating rod 30 is later described in more detail with reference to FIGS. 5, 6 and 7.

The inner surface 28 of the support 20 provides a surface for liquid to wick onto the coil 24 at the points 29 of contact between the coil 24 and the channel 23 walls 28. The inner surface 28 of the support 20 also provides surface area for exposing wicked liquid to the heat of the heating element 21.

There exists a continuous inner cavity 31 within the electronic cigarette 1 formed by the adjacent hollow interiors' of the mouthpiece casing 15 and the battery assembly casing 8.

In use, a user sucks on the second end 17 of the mouthpiece casing 15. This causes a drop in the air pressure throughout the inner cavity 31 of the electronic cigarette 1, particularly at the air outlet 4.

The pressure drop within the inner cavity 31 is detected by the pressure sensor 13. In response to detection of the pressure drop by the pressure sensor 13, the controller 14 triggers the provision of power from the power cell 9 to the heating element 21 via the electrical contacts 10, 26. The coil of the heating element 21 therefore heats up. Once the coil 17 heats up, liquid in the vaporization cavity 19 is vaporized. In more detail, liquid on the coil 24 is vaporized, liquid on the inner surface 28 of the heating element support 20 is vaporized and liquid in the portions 22 of the support 20 which are in the immediate vicinity of the heating element 21 may be vaporized.

The pressure drop within the inner cavity 31 also causes air from outside of the electronic cigarette 1 to be drawn, along route F, through the inner cavity from the air inlet 27 to the air outlet 4. As air is drawn along route F, it passes through the vaporization cavity 19, picking up vaporized liquid, and the air passageway 18. The vaporized liquid is therefore conveyed along the air passageway 18 and out of the air outlet 4 to be inhaled by the user.

As the air containing the vaporized liquid is conveyed to the air outlet 4, some of the vapor may condense, producing a fine suspension of liquid droplets in the airflow. Moreover, movement of air through the vaporizer 7 as the user sucks on the mouthpiece 2 can lift fine droplets of liquid off of the heating element 21 and/or the heating element support 20. The air passing out of the air outlet 4 may therefore comprise an aerosol of fine liquid droplets as well as vaporized liquid.

With reference to FIGS. 5, 6 and 7, due to the cross-sectional shape of the channel, gaps 35 are formed between the inner surface 28 of the heating element support 20 and the coil 24. In more detail, where the wire of the coil 24 passes between contact points 29, a gap 35 is provided between the wire and the area of the inner surface 28 closest to the wire due to the wire substantially maintaining its helical form. The distance between the wire and the surface 28 at each gap 35 is in the range of 10 micrometers to 500 micrometers. The gaps 35 are configured to facilitate the wicking of liquid onto the coil 24 through capillary action at the gaps 35. The gaps 35 also provide areas in which liquid can gather prior to vaporization, and thereby provide areas for liquid to be stored prior to vaporization. The gaps 35 also expose more of the coil 24 for increased vaporization in these areas.

Many alternatives and variations are possible. For example, in embodiments, the electronic vapor provision device 1 may be configured such that the coil 24 is mounted perpendicular to a longitudinal axis C of the device. Moreover, FIGS. 8 to 15 show examples of different heating rod 30 configurations.

Figure 8:
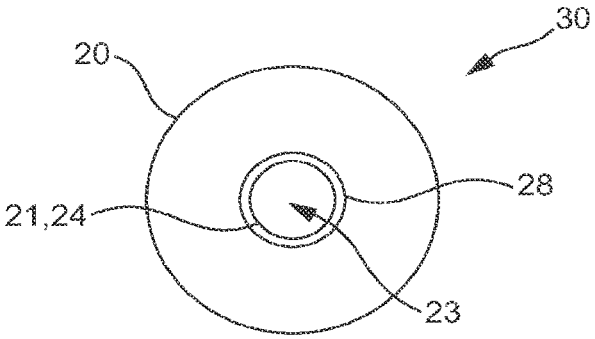
FIG. 8 is an end view of a heating element coil within an outer heating element support, where a central channel has a circular cross-section.

FIG. 8 shows another example heating element support 20. This is similar to the example above with the exception that the internal channel 23 has a circular cross-section rather than a square one. The coil 24 fits inside the channel 23 such that the coil turns are in contact with the channel walls 28. There is greater contact between the coil 24 and the channel walls 28 than the example above, with the entire coil 24 generally in contact with the channel walls 28 rather than contact at given points 29.

This increase in contact area means that more liquid can be transferred to the full length of the coil rather than particular points 29. However, since the coil 24 is generally in constant contact with the heating element support 20, less of the coil surface area is exposed. So in use, when the coil 24 heats up, there will be less vaporization surface.

These two examples show that a balance can be achieved between the amount of liquid on the coil 24 and the amount of vaporization surface exposed. This balance is varied by changing the amount of contact between the coil 24 and the channel 23 of the heating element support 20.

Figure 9:
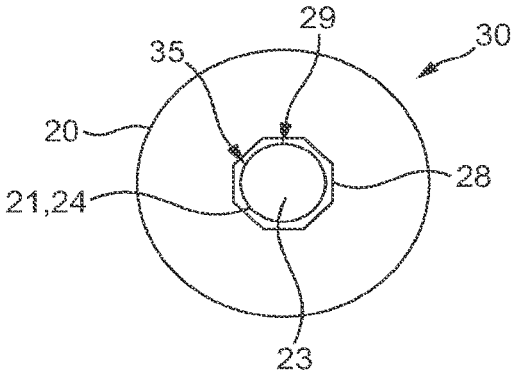
FIG. 9 is an end view of a heating element coil within an outer heating element support, where a central channel has an octagonal cross-section.

FIG. 9 shows an example where the amount of contact between the coil 24 and the channel 23 walls 28 lies between the examples shown in FIGS. 7 and 8. In this example, the channel 23 has an octagonal cross-section rather than a circle or a square. As such, the coil 24 has coil turns which are generally in contact with the channel 23 of the heating element support 20 at 8 points 29 of contact. More gaps 35 are provided by the configuration of FIG. 9 than the configuration of FIGS. 3 to 7. Moreover, the provided gaps 35 are smaller, leading to greater capillary action at the gaps.

When compared to the channel 23 with the square cross-section, the increased contact, greater number of gaps 35 and smaller gap sizes all facilitate increased liquid transfer onto the coil 24. The increased exposed coil 24 surface compared to the channel 23 with the circular cross-section allows for more exposed vaporization surface for increased vaporization.

In this way it can be seen that providing a heating element support 20 with an internal channel 23 having a regular polygon cross-section can be used to modify the amount of liquid transfer and the degree of vaporization by selecting the number of polygon sides. Thus, an optimum channel 23 cross-section can be selected.

In the examples above, the heating element support 20 has a cylindrical shape and therefore the outer surface cross-sectional shape is circular. This shape is advantageous because the mouthpiece 2 section is also cylindrical so the heating element support 20 can be efficiently fitted into the mouthpiece 2 to minimize wasted space.

Figure 10:
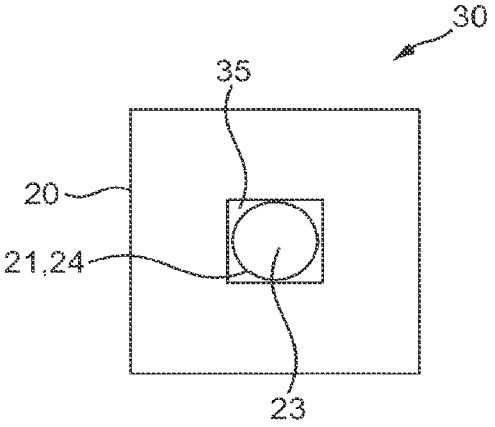
FIG. 10 is an end view of a heating element coil within an outer heating element support having an outer square cross-section, where a central channel has a square cross-section.

Other outer surface cross-sectional shapes may for example be configured as shown in FIG. 10 having a heating element support 20 with a square outer cross-sectional shape.

Figure 11:
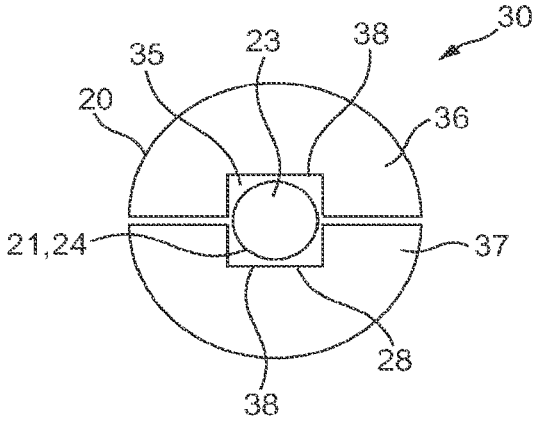
FIG. 11 is an end view of a heating element coil within an outer heating support having two sections.

FIG. 11 shows a heating element support 20 comprising a first support section 36 and a second support section 37. The heating element support 20 is generally cylindrical in shape and the first support section 36 and second support section 37 are half cylinders, with generally semi-circular cross-sections, which are joined together to form the cylindrical shape of the heating element support 20.

The first support section 36 and second support section 37 each comprise a side channel 38, or groove 38, running along their respective lengths, along the middle of their otherwise flat longitudinal faces. When the first support section 36 is joined to the second support section 37 to form the heating element support 20, their respective side channels 38 together form the heating elements support 20 internal channel 23.

In this example, the combined side channels 28 form an internal channel 23 having a square cross-sectional shape. Thus, the side channels 28 are each rectangular in cross-section. As in the examples above, the coil 24 is situated within the heating element support 20 internal channel 23. Having a heating element support 20 that comprises two separate parts 36, 37 facilitates manufacture of this component. During manufacturing, the coil 24 can be fitted into the side channel 28 of the first support section 36, and the second support section 37 can be placed on top to form the completed heating element support 20.

Figure 12:
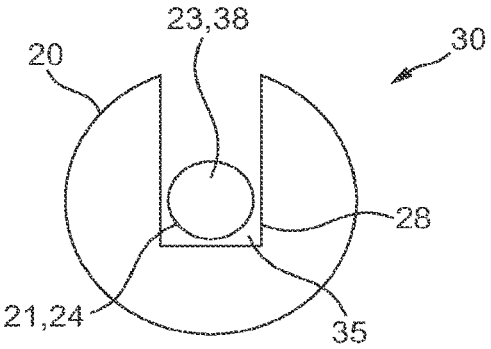
FIG. 12 is an end view of a heating element coil within a side channel of a heating element support.

Other arrangements can also be considered to aid the construction of the heating element support 20 and coil 24 combination. FIG. 12 shows an example having a generally cylindrical heating element support 20 similar to that shown in FIG. 7. However, the internal channel 23 is comprises a side channel 38 and the coil is thus not completely enclosed. The coil 24 can therefore be easily fitted into the open side channel 23, 38. Because the channel 23, 38 is open, the coil 24 has coil turns that are in contact with the channel walls 28 at three points 29 of contact rather than four.

Figure 13:
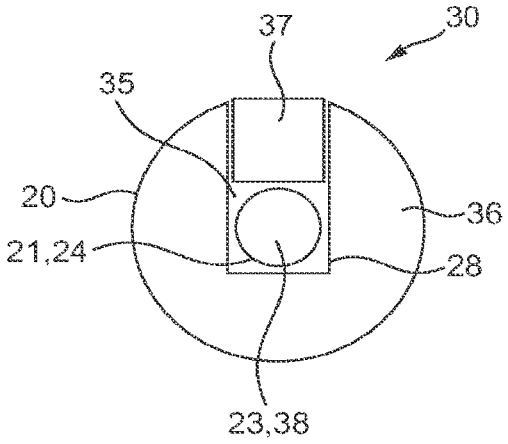
FIG. 13 is an end view of a heating element coil within a side channel of a heating element support, with a second support section.

FIG. 13 shows an example similar to that shown in FIG. 12 where the heating element support 20 of FIG. 12 is a first support section 36 and a second support section 37 is arranged such that it runs along the open channel 23, 38, plugging the open channel 38 and thereby closing it, and providing a combined arrangement similar to that shown in FIG. 7. Thus the coil 24 is enclosed inside an internal combined channel 23 and the coil turns are in contact with the channel 23 at four points 29 of contact, three points 29 of contact with the first support section 36 and one point 29 of contact with the second support section 36.

Figure 14:
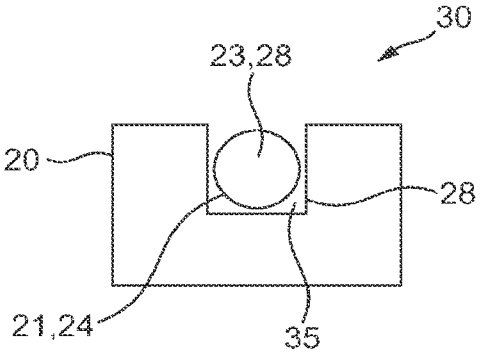
FIG. 14 is an end view of a heating element coil within a side channel of a heating element support having a rectangular cross-section.

FIG. 14 shows an example similar to that shown in FIG. 12 with the exception that the heating element support 20 has an outer rectangular cross-sectional shape. The coil 24 has coil turns having three points 29 of contact with the heating element support 20 channel 23.

Figure 15:
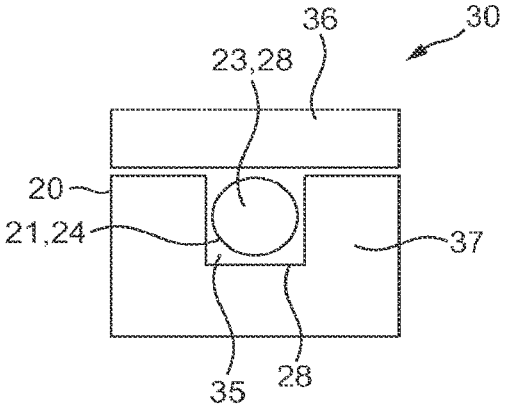
FIG. 15 is an end view of a heating element coil within a side channel of a heating element support having a rectangular cross-section, with a second support section.

FIG. 15 shows an example similar to that shown in FIG. 13 where a first support section 36 has an open side channel 38 and the coil 24 is fitted in this side channel. A second support section 37 is placed next to the first support section so that the coil 24 is enclosed between the support sections providing an arrangement similar to that shown in FIG. 10. The coil 24 has coil turns with four points 29 of contact with the heating element support 20 channel 23, 38, three with the first support section 36 and one with the second support section 37. Once the first support section 36 and the second support section 37 are joined to form the support 20, the formed support is substantially rectangular.

The wire of the coil 24 is described above as being approximately 0.12 mm thick. However, other wire diameters are possible. For example, the diameter of the coil 24 wire may be in the range of 0.05 mm to 0.2 mm. Moreover, the coil 24 length may be different to that described above. For example, the coil 24 length may be in the range of 20 mm to 40 mm.

The internal diameter of the coil 24 may be different to that described above. For example, the internal diameter of the coil 24 may be in the range of 0.5 mm to 2 mm.

The pitch of the helical coil 24 may be different to that described above. For example, the pitch may be between 120 micrometers and 600 micrometers.

Furthermore, although the distance of the voids between turns of the coil is described above as being approximately 300, different void distances are possible. For example, the void may be between 20 micrometers and 500 micrometers.

The size of the gaps 35 may be different to that described above.

In embodiments, the support 20 may be located partially or entirely within liquid store 6. For example, the support 20 may be located coaxially within the tube of the liquid store 6.

An air pressure sensor 13 is described herein. In embodiments, an airflow sensor may be used to detect that a user is sucking on the device 1.

The heating element 21 is not restricted to having a uniform coil 24. Moreover, in embodiments the coil 24 is described as being the same length as the support 20. However, the coil 24 may be shorter in length than the support 20 and may therefore reside entirely within the bounds of the support 20. Alternatively, the coil 24 may be longer than the support 20.

An electronic vapor provision device 1 comprising an electronic cigarette 1 is described herein. However, other types of electronic vapor provision device 1 are possible.

Liquid may not be wicked and/or stored by the support 20 and could instead be wicked from the liquid store 6 to the coil and/or the inner surface 28 of the support 20 by a separate wicking element. In this case, the support 20 may not be porous.

Internal support channels 23 with cross-sectional shapes other than those described could be used.

The electronic vapor provision device 1 is not restricted to the sequence of components described and other sequences could be used such as the control circuit 11 being in the tip of the device 1 or the liquid store 6 being in the body 3 rather than the mouthpiece 2.

The electronic vapor provision device 1 of FIG. 2 is described as comprising two detachable parts, the mouthpiece 2 and the body 3, comprising the battery assembly 5. Alternatively, the device 1 may be configured such these parts 2, 5 are combined into a single integrated unit. In other words, the mouthpiece 2 and the body 3 may not be detachable.

Reference herein to a vaporization cavity 19 may be replaced by reference to a vaporization region.

Although examples have been shown and described it will be appreciated by those skilled in the art that various changes and modifications might be made without departing from the scope of the invention.

In order to address various issues and advance the art, the entirety of this disclosure shows by way of illustration various embodiments in which the claimed invention(s) may be practiced and provide for superior electronic vapor provision. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilized and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future. Any feature of any embodiment can be used independently of, or in combination with, any other feature.

The invention claimed is:

1. An electronic vapor provision device comprising a power cell and a vaporizer, where the vaporizer comprises a heating element and a heating element support, wherein the heating element is on the inside of the heating element support, wherein one or more gaps are provided between the heating element and the inner surface of the heating element support, wherein the heating element is in contact with the heating element support at two or more locations, wherein the heating element support is elongated in a lengthwise direction, wherein the vaporizer further comprises a vaporization region configured such that in use the vaporization region is a negative pressure region, wherein at least part of the heating element is inside the vaporization region, wherein the heating element support is substantially cylindrical, wherein the outer cross-sectional shape of the heating element support is a circle, and wherein the heating element support includes a support channel in which the heating element is located, wherein the cross-sectional shape of the heating element support channel is a polygon.

2. The electronic vapor provision device of claim 1, wherein the electronic vapor provision device further comprises a mouthpiece section and the vaporizer is part of the mouthpiece section.

3. The electronic vapor provision device of claim 1, wherein the heating element is located such that the axis of the heating element is substantially parallel to airflow though the device when a user sucks on the device.

4. The electronic vapor provision device of claim 1, wherein the heating element is the same length as the heating element support, such that ends of the heating element are flush with ends of the heating element support.

5. The electronic vapor provision device of claim 1, wherein the distance between the heating element and the inner surface of the heating element support at each gap is in the range of 10 micrometers to 500 micrometers.

6. The electronic vapor provision device of claim 1, wherein the heating element is not supported on its inside.

7. The electronic vapor provision device of claim 1, wherein the heating element support is porous.

8. The electronic vapor provision device of claim 1, wherein the vaporization region is inside the heating element support.

9. A mouthpiece section adapted to detachably couple to a battery assembly of an electronic vapor provision device comprising a power cell, wherein the mouthpiece section comprises a vaporizer, where the vaporizer comprises a heating element and a heating element support, wherein the heating element is on the inside of the heating element support, wherein one or more gaps are provided between the heating element and the inner surface of the heating element support, wherein the heating element is in contact with the heating element support at two or more locations, wherein the heating element support is elongated in a lengthwise direction, wherein the vaporizer further comprises a vaporization region configured such that in use the vaporization region is a negative pressure region, wherein at least part of the heating element is inside the vaporization region, wherein the heating element support is substantially cylindrical, wherein the outer cross-sectional shape of the heating element support is a circle, wherein the heating element support includes a support channel in which the heating element is located, and wherein the cross-sectional shape of the heating element support channel is a polygon.

* * * * *